United States Patent [19]

Rouse

[11] 4,252,320

[45] Feb. 24, 1981

[54] MAZE BOARD GAME APPARATUS

[76] Inventor: Glenn R. Rouse, Harbor Lights, Eagle Harbor, Mich. 49951

[21] Appl. No.: 946,656

[22] Filed: Sep. 27, 1978

[51] Int. Cl.[3] ..... A63F 3/00

[52] U.S. Cl. ..... 273/243; 273/248

[58] Field of Search ..... 273/243, 249, 248, 282, 273/258, 262; 211/14, 125

[56] References Cited

U.S. PATENT DOCUMENTS

| | | | |
|---|---|---|---|
| 1,315,483 | 9/1919 | Edwards | 273/262 |
| 1,747,767 | 2/1930 | French | 273/249 |
| 3,807,740 | 4/1974 | Allred | 273/253 |
| 3,858,883 | 1/1975 | Fabricant | 273/249 X |
| 3,895,804 | 7/1975 | Lee | 273/282 X |
| 3,948,526 | 4/1976 | Lukacik | 273/282 X |

FOREIGN PATENT DOCUMENTS

| | | | |
|---|---|---|---|
| 2222438 | 11/1973 | Fed. Rep. of Germany | 273/248 |
| 1042543 | 11/1953 | France | 273/249 |

*Primary Examiner*—Richard C. Pinkham
*Assistant Examiner*—Scott L. Brown
*Attorney, Agent, or Firm*—Paul J. Van Tricht

[57] ABSTRACT

A board game apparatus for play by three players or groups of players which includes a game board bearing a substantially rectangular maze thereon. The maze is divided into a number of spaces or steps and includes a number of blocking positions. Residence strips are delineated or formed adjacent three sides of the maze. On the residence strips are delineated number of residence positions. Starting positions are delineated on the remaining fourth side of the maze. Play of the game is dictated by dice. A marker is placed on one of the residence positions on each of the three residence strips. This marker is designated a Residence. The object of the game is to move a marker or token from a starting position through the maze to visit the space directly in front of a Residence, a Doorstep. The dice also determine the opportunity for a player to place or move a blocking marker into a blocking position on the maze and thereby impede the movement of the other players token. Points or "Bugs" are scored by visiting the doorstep of all three Residence on the board in any order. Also included on the game board are blocking and scoring marker holding rows, a dice storage area, a visit-indicator, a Bug counter, and a token holding device.

9 Claims, 6 Drawing Figures

MAZE BOARD GAME APPARATUS

BACKGROUND OF THE INVENTION

1. Field of the Invention

The present invention generally relates to board games. More particularly, the invention relates to a maze board game for play by three players of groups of players. Chance means, e.g., dice, determine the play. The U.S. classification for board games is 273/134; the international classification is A63F3/00.

2. Brief Description of the Prior Art

Board game aparatus are popular forms of entertainment. Typical board game apparatus are described in U.S. Pat. Nos. 3,506,268; 3,807,740; 3,809,408; 3,951,412; and 4,033,587.

It is a general object of the present invention to provide a new and improved maze game board apparatus for entertainment.

BRIEF SUMMARY OF THE INVENTION

The present invention is a game board apparatus for play by three players or groups of players. In terms of broad inclusion, the game board apparatus includes a game board with a substantially rectangular maze delineated on its surface. The maze is delineated into a plurality of progress spaces or positions. Preferably, the progress spaces are indentations which are capable of holding a ball, marble, or similar position indicating means or token. Also, delineated in the maze are a plurality of blocking spaces or positions for the placement of blocking marker means. Preferably, the blocking positions are holes in the board and pegs are used as blocking and scoring means or markers. Narrow goal areas or residence strips are delineated directly adjacent to and parallel to three sides of the maze. On the residence strips are delineated a plurality of goal or residence positions, e.g., holes. On the residence positions are placed goal marker means or Residence. Adjacent the residence strips are a series of score keeping areas e.g., rows of holes for the placement of score keeping pegs. Starting positions for the tokens are delineated on the fourth side of the maze. Adjacent to the fourth side of the maze are a series rows of holes for the storage of pegs which are used as blocking and scoring means or markers, a dice holder, and a position indicating marker or token holding means. Each player selects one set of tokens, goal marker means, blocking and score keeping means, and goal areas which are color coded. At the start of the game an appropriate goal marker means, Residence, is placed in one of the goal or residence positions on each of the three goal areas or residence strips. The order of play and play of the game is determined by chance means, e.g., dice. The movement of the position indicating means or tokens is started from one of the starting positions. The movements of the position indicating means in the position spaces of the maze are determined by the number rolled on the dice. If the player rolls one of a set of predetermined numbers in accordance with the set of markers, Residence, etc., the player has selected, the player may place or move a blocking means into a blocking position on the maze. Scoring is accomplished by moving the position indicating means or token to the position on the maze directly adjacent the goal marker means or Residence. This position is designated as a Doorstep and movement of the token to a Doorstep is designated a Visit. Upon visiting the Doorstep of each of the Three Residence, the player scores and obtains a Bug. A record of the number of Bugs obtained by each player is indicated by the placement of scoring means in the score keeping areas. Victory is achieved by obtaining a predetermined number of Bugs.

DESCRIPTION OF THE PREFERRED EMBODIMENT

Figure 1:
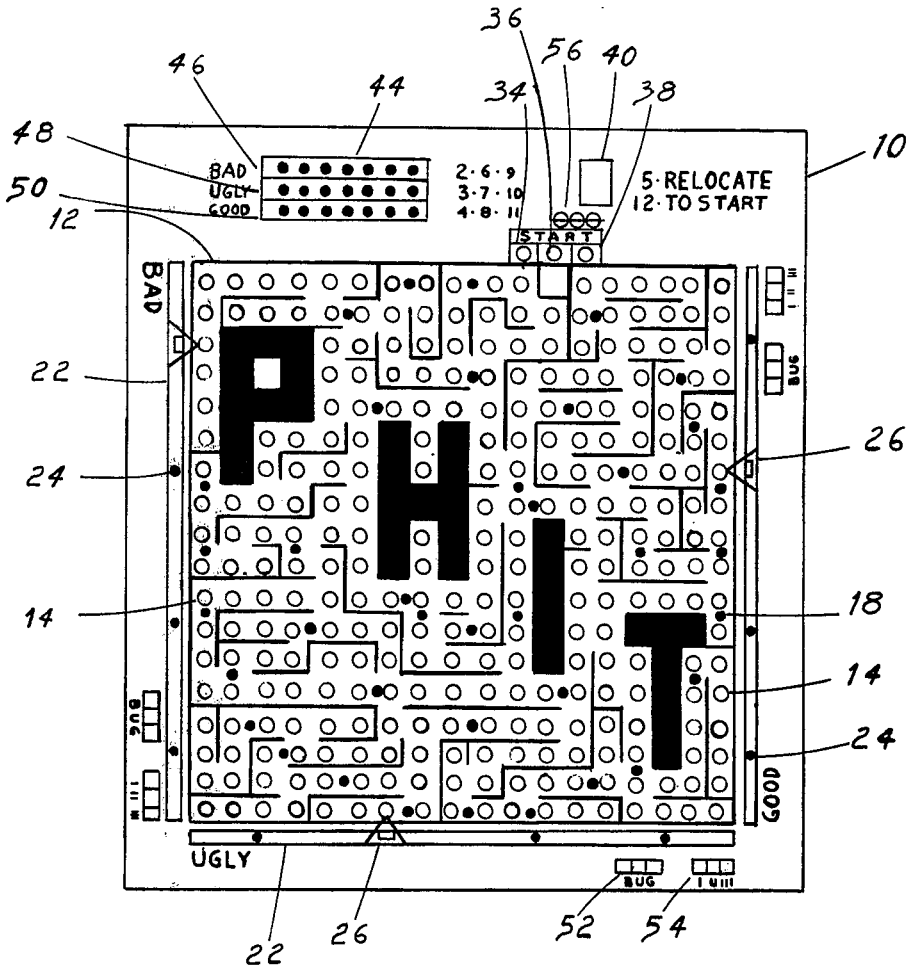
FIG. 1 is a plain view of the face of the maze game board which shows the playing surface of the game board.

Referring now to FIG. 1, the present invention includes a game board 10. The game board may be constructed of wood, cardboard, pressed paper, metal, plastic, composition board or any other suitable material. The board 10 may be of any suitable material provided the essential elements of the invention which are described herein below are included on the board.

Figure 5:
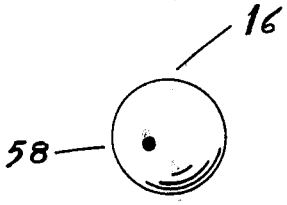
FIG. 5 is a perspective view of a position indicating marker means, i.e., marble, which is employed in the present invention.

Stamped, printed, painted or otherwise designated on a surface of the board 10 is a substantially rectangular maze 12. The name of the game, e.g., PHIT TM, may be inscribed in and made a part of the maze 12. The maze 12 is divided into a plurality of progress spaces, positions or steps 14. These steps 14 may be simple marks in the maze 12. Preferably, the steps 14 are indentations in the board 10 which are capable of holding the preferred position indicating means. Referring now to FIG. 5, the preferred position indicating means or token is a marble or ball 16. However, the position indicating means or token may be a piece of paper or plastic, if desired.

Figure 2:
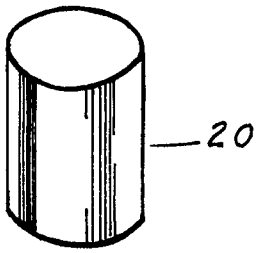
FIG. 2 is a perspective view of a blocking and scoring means, i.e., peg, of the present invention.

In the maze 12 are located a plurality of blocking spaces or positions 18. The blocking position 18 may be a simple mark on the maze 12. Preferably, the blocking position 18 is an indentation or hole in the board 10 which is capable of holding a blocking means or marker. Referring now to FIG. 2, the preferred blocking means or marker is a peg 20. Again, the blocking means or marker may be a simple piece of paper or plastic, if desired.

Figure 4:
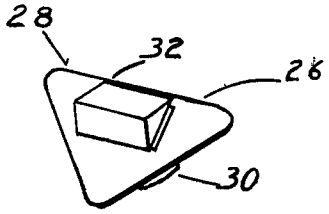
FIG. 4 is a perspective view of a goal marker means or Residence which is employed in the present invention.

On three sides of the maze 12 goal areas or residence strips 22 are inscribed, printed, painted, or otherwise applied to the board 10. The residence strips 22 are narrow rectangular strips which substantially parallel three sides of the maze 12 along substantially the entire length of each side. On each of the residence strips are a plurality of goal or residence positions 24. The goal or residence positions 24 may be a simple mark or spot on the strip 20. Preferably, the residence position 24 is an indentation or hole in the board 10 which is capable of holding a goal marker means or Residence 26. Referring now to FIG. 4 the preferred goal marker means or Residence 26 is flat triangular body 28 with a peg 30 which is attached to one side of the triangular body 28 and which is capable of being securely placed in the residence position hole 24. The remaining side of the triangular body 28 has a house figurine 32 upon it. Again, the goal marker on Residence 26 may be a simple piece of paper or plastic, if desired.

On the remaining fourth side of the maze 12 are a series of one or more starting positions 34, 36 and 38 which are imprinted on the board 10.

Figure 3:
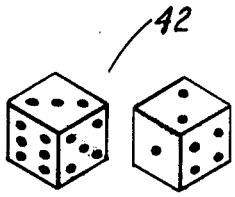
FIG. 3 is a perspective view of a pair of dice which is employed to play the game.

The board 10 includes a dice holding indentation or hole 40 which is capable of securely holding a pair of dice 42. A typical pair of dice 42 are shown in FIG. 3. The board includes a peg storage area 44. The storage area is three parallel rows of holes 46, 48 and 50 for holding and storing the blocking and score indicating pegs 20.

The peg rows 46, 48 and 50 may be color coded to match the color of the three sets of pegs 20 which in turn match the color of one of each of the residence strips 22 and the Residence 26. Further, each set of rows, pegs, residence strips and Residence may be designated by a name, e.g., "Good", "Bad", and "Ugly". Adjacent each residence strip 22 are one or more score keeping positions or marks 52 and 54. The score keeping areas or positions 52 and 54 may be simple marks on the board 10. Preferably, the score keeping positions 52 and 54 are a row of holes which are capable of holding the scoring pegs 20.

Figure 6:
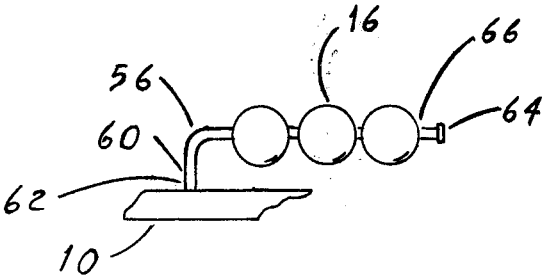
FIG. 6 is a side view of a position indicating marker holding device which is employed in the present invention.

Referring now to FIGS. 5 and 6, the present invention includes a position indicating means or marble holder 56. The marble or ball 16 includes a hole 58 which runs completely through the marble 16. The moveable marker holder 56 is a substantially cylindrical rigid rod 60. The rod 60 may be made of steel, plastic, or a similar rigid material. One end 62 of the rod 60 is embedded in the board 10 and the rod 60 extends perpendicular from the board 10. At a distance from the board 10 which is greater than the radius of the moveable marker 16 the rod 60 is bent at an approximately right angle so as to be substantially parallel to the surface of the board 10. The remaining end 66 of the rod 60 is free. The diameter of the hole 58 in the moveable marker 16 is slightly larger than that of the rod 60. In operation the moveable markers 16 are slid over the rod 60 and secured to the moveable marker holder 56 by means of a flexible ring or tube 64 which fits securely over the free end 66 of the rod 60.

The game may be played by up to three players or three teams of players. The object of the game is to step through the maze, visit Residences, and win by being the first to collect the prescribed number of Bugs. A Bug is a visit to each of the three Residence in any order.

The players first choose their respective set of color coded position indicating means 16, Residences 26, and pegs 20. The Residence 26 is placed in one of the goal or residence positions 24 in the appropriate goal area or residence strips 22. The order of play is determined by rolling the dice 42. In turn, each player rolls the dice 42 which dictates the game action including the movement of the moveable marker 16, the opportunity to place or move a blocking peg 20 in the maze 12, and the opportunity to relocate the Residence 26. Play is started from any of the starting positions 34, 36, and 38. If the player has chosen the set of marbles 16, pegs 20, Residence 26 and residence strips 22 which are designated "Bad" then when the player rolls a 2, 6 or 9 on the dice 42 the player may move a red peg, red being the color code for "Bad", from the storage row 46 onto a blocking space or position 18 in the maze 12 or shift a red peg that is in the maze 12 to a new blocking position 18 in the maze 12. Then the player may move the moveable marker 16 the number of steps 14 indicated on the dice 42, if the player can. An identical procedure is followed for the placement of pegs 20 in blocking positions 18 for the two other players: 3, 7, 10 being the pertinent dice numbers for the placement of blocking pegs for "Ugly" and 4, 8, 11 being the dice pertinent numbers for the placement of blocking pegs for "Good". There is an approximately equal probability of rolling a "Bad", "Ugly", or "Good" number. If any player rolls a 5 on the dice 42, the player may move the Residence 26 to a new position 24 on the residence strip 22. If a player rolls a 12 the player must return his moveable marker 16 to a start position 34, 36 or 38 without any pegs 20 and without moving the moveable marker 16 any steps. If a player rolls the appropriate number on the dice 42, the player is entitled to place a peg 20 in a blocking position 14 or move a peg 20 already on the maze 12 into a new blocking space or position 14 even if the player cannot move the moveable marker 16. The pegs 20 serve as aids or as blocks. A player's moveable marker 16 may trespass his own colored pegs 20, an aid to his strategy. But a player may not move his moveable marker 16 past an opponent's blocking peg. The only pegs 20 that can be returned to the Storage area 44 are those pegs 20 which were used in scoring. All moves of the moveable marker 16 must follow the direction the player originally choose—the move is completed after the player removes his fingers from the moveable marker 16. As long as the player has room to make a move, the player must do so, even if the move sends the player's marker away from the player's destination.

If the player's roll of the dice places the player on the same step as that of an opponent, then the player is not allowed to complete that move; the player must use an alternative passage.

Each time a player reaches the step directly in front of a Residence 26 he has made a successful visit. The step directly in front of a Residence 26 is called a Doorstep. All that a player needs is a sufficient number on the dice to get the moveable marker 16 to the Doorstep; the player does not need the exact number. As long as one player's marble 16 remains on a Doorstep an opponent's marble 16 cannot visit the same Doorstep. A player cannot keep his moveable marker 16 on a Doorstep; on the player's next turn the player must continue on to his next visit unless the player just obtained a Bug. When the player obtains a Bug he must return to Start and on the next turn depart from a starting position 34, 36, or 38. Each visit is marked in the player's visit-indicator 52 with one of the players pegs 20. The peg may be taken from the maze 12 or from the player's peg row 46, 48 or 50 in the storage area 44. After a player's moveable marker 16 visits all three Residences 26, in any order, the player has a Bug. The player then puts a peg 20 in the first hole of the player's Bug-counter 54. The peg 20 used to indicate the Bug should be taken from the visit-indicator 52. The remaining pegs 20 in the visit-indicator should be returned to the appropriate peg row 46, 48, or 50 in the Storage area 44.

Before the game begins, the players decide on how many Bugs are needed to win (I, II or III). The game duration is variable; a three Bug game might take three hours.

Various changes can be made in the specific features of the game without deviating from the basic structure. For this reason, only the following claims are intended herein as the only limiting definitions of the game concept.

Having described my invention, I claim:

1. A game apparatus comprising:

(a) A game board having designated thereon:

(i) a substantially rectangular maze, said maze being delineated into a plurality of progress spaces and said maze having thereon a plurality of blocking positions, (ii) three goal areas which are adjacent to and are substantially parallel to three sides of said rectangular maze, said goal areas being separate and distinct from said progress spaces and said blocking positions and containing a plurality of goal positions, and (iii) one or more starting positions on the remaining fourth side of said rectangular maze;

(b) Position indicating tokens for placement on said progress spaces;

(c) Blocking markers for placement on said blocking positions;

(d) Goal marker means for placement on said goal positions; and (e) Chance means for determining the play of the game.

2. A game apparatus of claim 1 wherein said position indicating tokens are marbles, said progress spaces are indentations in said game board capable of holding said marbles, said marbles contain holes running through said marbles, and said apparatus includes a marble holder comprising:

(a) A substantially cylindrical rigid rod having a diameter less than the diameter of said hole in said marble, having one end embedded in said game board, and having a remaining portion which extends perpendicular from said board and bends at an angle substantially parallel to the surface of said board at a distance from said board greater than the radii of said marbles; and (b) A flexible ring which fits securely over the remaining free end of said rod.

3. A board game apparatus of claim 1 wherein said goal areas are three differently colored substantially rectangular strips, said board contains three separate score keeping areas, one of said score keeping areas adjacent each of said goal areas, said tokens are three sets of tokens, one set of said tokens colored to match the color of one of said goal areas, and said blocking markers are three sets of colored blocking markers, one set of said markers colored to match the color of one of said goal areas.

4. A board game apparatus of claim 1 wherein said maze designated on said board includes the name of the game.

5. A game apparatus of claim 1 wherein said blocking positions are arranged substantially concentrically within said maze.

6. A game apparatus of claim 1 wherein said goal marker means are moveable goal marker means which when placed on one of said goal positions designate a progress space in said maze directly adjacent said goal position.

7. A game apparatus of claim 1 wherein said blocking markers comprise three sets of blocking markers and said board includes a blocking marker storage area on said fourth side of said rectangular maze, said storage area including a separate area for each of said three sets of blocking markers, one each of said three areas being designated by the set of numbers 2-6-9, 3-7-10 or 4-8-11 delineated on said game board adjacent said three areas.

8. A game apparatus of claim 1 wherein said board includes three separate score keeping areas designated thereon, one of said score keeping areas adjacent each of said goal areas, and wherein said apparatus includes scoring markers for placement on said score keeping areas.

9. A game apparatus of claim 1 wherein said blocking markers are used as said scoring markers.

* * * * *